United States Patent [19]

Lawrence et al.

[11] 3,976,299

[45] Aug. 24, 1976

[54] GOLF CLUB HEAD APPARATUS

[76] Inventors: Philip E. Lawrence, 17434 N. 21st Drive; Boris M. Plesinger, 36 W. Moon Valley Drive, both of Phoenix, Ariz. 85023

[22] Filed: Dec. 16, 1974

[21] Appl. No.: 533,237

[52] U.S. Cl. ..... 273/171; 273/167 E; 273/167 F

[51] Int. Cl.[2] ..... A63B 53/04

[58] Field of Search ..... 273/77 R, 77 A, 163 R, 273/164, 167–175; D34/5 GH, 5 GC, 5 GS, 5 CB

[56] References Cited

UNITED STATES PATENTS

| | | | |
|---|---|---|---|
| 1,139,985 | 5/1915 | Legh | 273/167 F X |
| 1,541,126 | 6/1925 | Dunn | 273/167 A |
| 1,555,425 | 9/1925 | McKenzie | 273/167 E X |
| 1,840,924 | 1/1932 | Tucker | 273/171 X |
| 1,916,792 | 7/1933 | Hadden | 273/167 A X |
| 1,993,928 | 3/1935 | Glover | 273/167 F X |
| 2,041,676 | 5/1936 | Gallagher | 273/167 A X |
| 3,625,518 | 12/1971 | Solheim | 273/175 |
| 3,810,631 | 5/1974 | Braly | 273/167 A |
| D149,156 | 3/1948 | Weatherington | D34/5 GH |
| D191,211 | 8/1961 | Forest | 273/16 FF X |

FOREIGN PATENTS OR APPLICATIONS

| | | | |
|---|---|---|---|
| 440,379 | 12/1935 | United Kingdom | 273/171 |

*Primary Examiner*—Richard J. Apley
*Attorney, Agent, or Firm*—H. Gordon Shields

[57] ABSTRACT

Golf club head apparatus is disclosed which includes a curved top portion with a concave portion beneath the curved top portion and internally adjustable weights are disposed adjacent the face of the club head.

5 Claims, 14 Drawing Figures

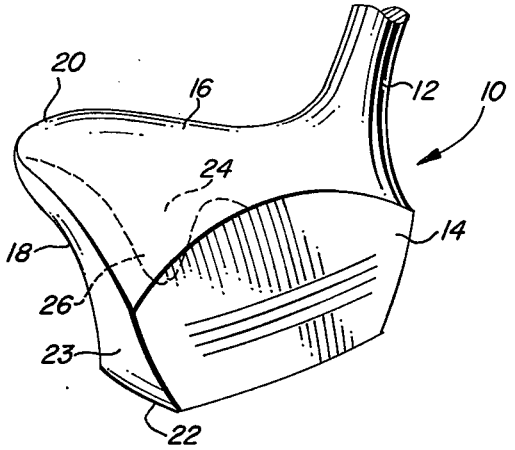
FIG-1
FIG-2
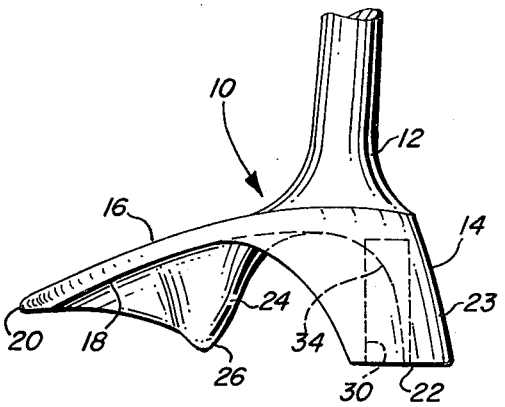
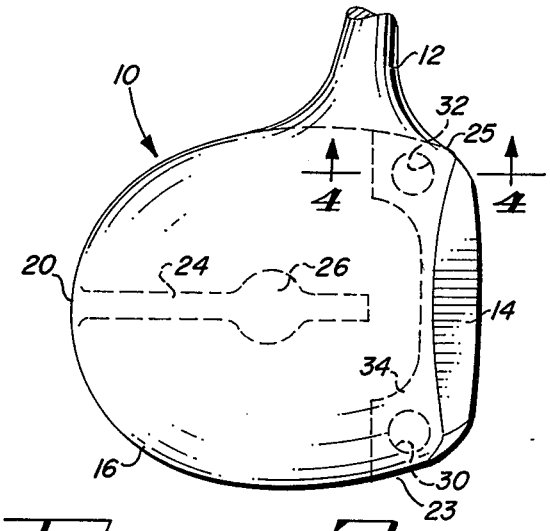
FIG-3
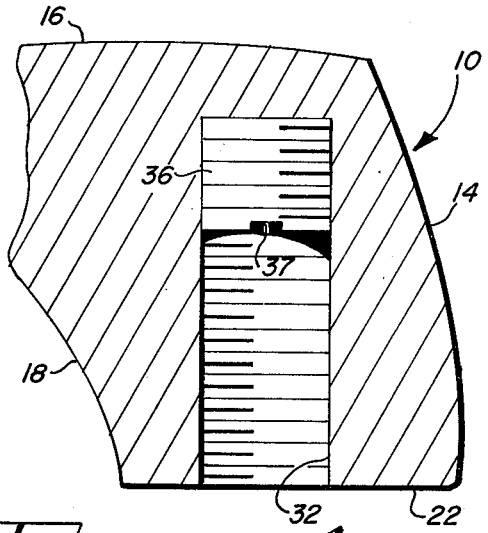
FIG-4
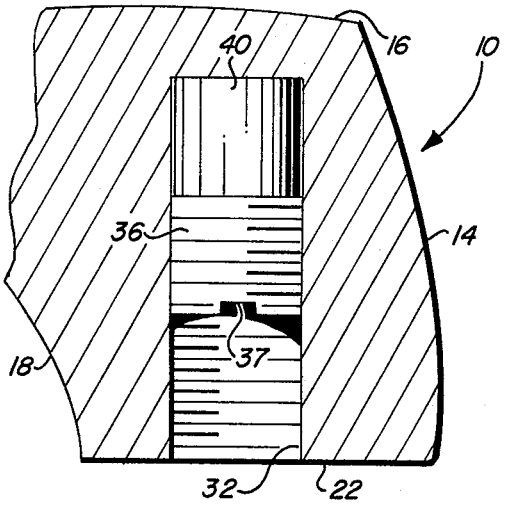
FIG-5
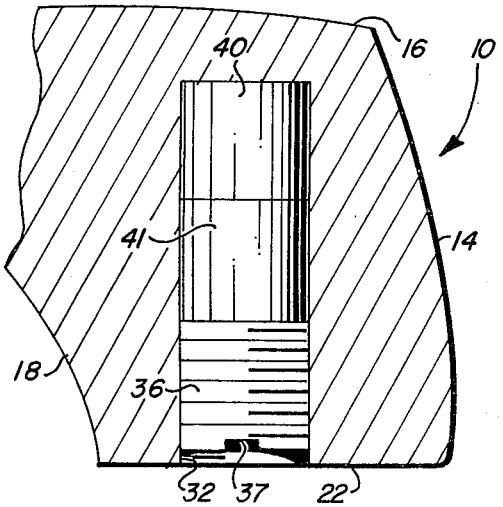
FIG-6

GOLF CLUB HEAD APPARATUS

BACKGROUND OF THE INVENTION

1. Field of the Invention

This invention relates to golf club heads, and, more particularly, to golf club heads having an aerodynamic configuration and having weights disposed within the club head and adjustable as desired.

DESCRIPTION OF THE PRIOR ART

Golf is one of the most popular pastimes or activities which is participated in by both men and women. Increasingly, the game is becoming popular with men and women of all ages, including the younger set, such as teen agers, as well as older, retired people. Moreover, golf is a game which may be played by people almost without regard to their physical abilities. Thus people of varying statures and physical strength and ability can all enjoy the game of golf. With a wide diversity of people, virtually without regard to sex, age, or size, all playing golf, it is obvious that a variety of golf clubs must be available. No one size or shape or weight of club will suit each individual. To meet the demand for golf clubs to satisfy the wide variety of people who participate in the game, there has been a myriad of designs for golf clubs and golf heads. Each different design or configuration of golf club has been made in varying weights and in varying sizes. Each club in a set of golf clubs is designed for a specific purpose and is used accordingly under certain circumstances which set the purpose for which the club is designed. To fit the varying circumstances which a golfer may encounter in playing the game, there have been many modifications of the "standard" golf clubs which are normally considered as comprising a set. The variations and permutations of golf club designs are substantial in number and new concepts are continually evolving from old designs and from new developments in materials, such as metals and plastics, which are continually being developed.

There are two factors which are of substantial importance in a golf club design, one factor is the configuration of the head which will allow the head to move in a straight arc as the golfer swings the club, and the other factor is the weight of the head and the distribution of the weight of the head which results from the design of the head and from the distribution of the weight according to the design of the head and of the materials out of which the head is made. Each individual golfer, regardless of their size, strength, and the like, may require a different distribution of the weight of the head and accordingly a good weight distribution or head design for one golfer may not be appropriate for another golfer although the two golfers are substantially alike physically. Obviously, with variations in physical attributes, a golf club design for one individual may or may not be appropriate and preferable for another individual. To overcome this problem, various design configurations of heads have been developed over the years, and varying types of weight distribution systems have been developed. Some heads have cavities in which weights may be placed either in the form of lead weights or lead or other type of shim material. This allows one golf head to be adjusted to suit the particular needs of several different golfers.

Various aerodynamic configurations have been suggested to aid in the proper movement of a club head as it arcs in response to the golfer using the club. Ideally, a club head should move smoothly through the air from the top of the swing until it contacts a golf ball at the bottom of a swing. If the face of the club does not make proper contact with the ball, the ball will not move in a true, directed path of flight, but rather will hook or slice, depending on the manner in which the head contacted the ball.

The speed of the club head can also be translated into distance the ball will travel. The faster the swing of the club, the farther the ball will travel. Accordingly, aerodynamic design and stability are important factors.

Prior art golf clubs have some type of inserts in the face of the clubs. Such inserts are not needed and are not used with the golf clubs herein disclosed because the clubs are cast of appropriate metal, such as magnesium, aluminum, or the like, or an appropriate plastic. Thus the need for an insert is eliminated.

SUMMARY OF THE INVENTION

The invention described and claimed herein comprises a golf club head which includes an aerodynamic design or "wing" configuration with a minimum sole plate to provide minimum drag or resistance to the air during the swing of the club and also to provide aerodynamic stability to the head as it swings through the air, and an internally adjustable weight system to allow a golfer to adjust weights in the head in two axis or dimensions.

Among the objects of the present invention are the following:

To provide new and useful golf club head apparatus;

To provide new and useful golf club head apparatus having an aerodynamic configuration;

To provide new and useful golf club head apparatus having adjustable weights in the head;

To provide new and useful golf club head apparatus having internally adjustable weights;

To provide new and useful golf club head apparatus having a concave portion and a convex portion adjacent the face of the club;

To provide new and useful golf club apparatus having a convex portion extending from the face of the club; and To provide new and useful golf club apparatus having a concave portion extending from the sole plate of the club.

BRIEF DESCRIPTION OF THE DRAWING

FIG. 1 is an isometric view of golf club apparatus embodying the present invention.

FIG. 2 is a side view of the apparatus of FIG. 1.

FIG. 3 is a plan view of the apparatus of FIGS. 1 and 2.

FIG. 4 is an enlarged view in partial section taken along line 4—4 of FIG. 3.

FIGS. 5 and 6 are views in partial section similar to FIG. 4 and illustrating the apparatus shown therein.

DESCRIPTION OF THE PREFERRED EMBODIMENT

Figure 7:
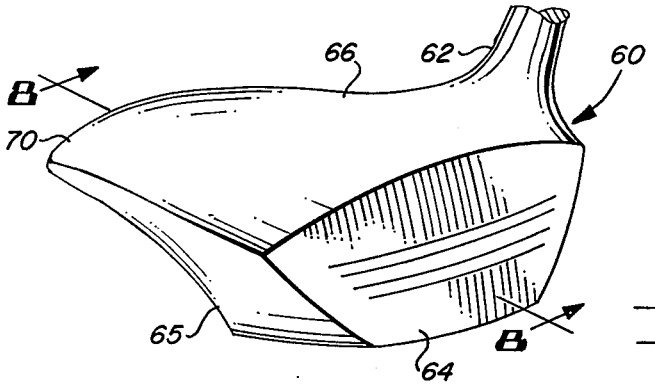
FIG. 7 is an isometric view of an alternate embodiment of apparatus embodying the present invention.

FIG. 1 is an isometric view of golf club apparatus embodying the present invention.

Golf club apparatus 10 includes hosel 12 which is connected to the shaft of the club, and a face 14 which makes contact with the golf ball. Extending from the upper portion of the face 14 is a wing 16, which is of a convex configuration which comprises an aerodynamic surface. Underneath the wing 16 is an arch 18, which is concave in configuration and extends substantially underneath the head of the golf club. The arch 18 defines a concave surface beneath the wing 16. The hosel 12 extends from the upper wing surface 16 adjacent the side 14 at an edge of the top wing surface 16. Substantially the entire top surface area of the wing 16 is aerodynamically configured. The wing extends from the upper portion of face 14 and terminates in a trailing portion 20. The trailing portion 20 is remote from both the face and the hosel 12.

A sole 22 extends from the underneath portion of the head and adjacent the face 14. Due to the configuration of the wing 16 and of the arch 18, the sole 22 is quite small in area with respect to the entire size of the golf club head. The width of the sole 22 is sufficient to allow the club head to rest on the ground and to be balanced and to remain in a balanced position as desired by the user of a club embodying the head apparatus disclosed herein.

If the face 14 of the golf club head 10 is considered the front of the club, then the top wing surface 16 tapers to a trailing edge 20. Between the face 14 and the trailing edge 20, and located rearwardly from the sole 22, is a center web 24 which extends from underneath the top wing surface downwardly from the arch 18. The center web includes a stabilizing foot 26. When the sole 22 is disposed on the ground in the proper position, the stabilizing foot 26 also makes contact with the ground. The web 24 and the foot 26 are shown in phantom in FIG. 1.

Extending upwardly from the sole 22 and backwardly from the face 14 is a side 23. The side 23 extends both upwardly and rearwardly and tapers to join the wing 16 towards the trailing edge 20. There is a side 25 generally parallel to side 23 on the opposite side of the club head and adjacent hosel 12, and connected thereto. (See FIG. 3.)

FIG. 2 comprises a side view of the apparatus of FIG. 1. The golf club apparatus 10 is shown with the hosel 12 extending upwardly from the top wing surface 16 of the golf club head. Face 14 extends upwardly and slightly rearwardly from the bottom portion of the club head adjacent the sole 22. The wing 16 extends in a curve from the upper portion of the face 14 of the golf club and terminates in a trailing edge 20. The side 23 extends from the sole 22 and the face 14 to the wing 16.

The center web 24 extends downwardly from the arch 18 on the underneath side of the surface of the wing 16. The stabilizing foot 26 is substantially on the same plane as the sole 22, and which is generally the position of the head when a user is in a position of play with the sole and the stabilizing foot on the ground in proper position.

The narrow width of the sole 22 is clearly shown in FIG. 2.

Within the golf club head, and extending upwardly from the sole of the head, is a microbalancing system comprising a pair of tapped apertures. A tapped aperture 30 is shown in phantom in FIG. 2. The tapped apertures extend upwardly within the head from the sole 22. The thickness of the club between the sole and the wing 16 and adjacent the face 14 is not uniform, but rather is thicker adjacent the edges of the face than in the center of the face. The thickness varies from the sole upwardly to the arch 18. A portion of the inner surface of the thickness variation, which comprises an inner recess of the concave arch behind the face 14 and inwardly from the sides 23 and 25, is outlined in phantom and indicated by reference numeral 34.

FIG. 3 is a top view of the golf club head apparatus 10 of FIGS. 1 and 2. The hosel 12 is shown extending outwardly (and upwardly) from the golf club head 10 and from the wing 16 of the head. The face 14 is disposed at one end of the head, while the trailing edge 20 is at the opposite end of the head. The face 14 extends downwardly from the wing 16 at a slight angle, which is shown in FIG. 3, and which angle is shown more plainly in FIG. 2.

Since FIG. 3 is a top view, several portions of the golf club head apparatus are shown only in phantom in FIG. 3. For example, the center web 24, with its stabilizing foot 26, is shown in dotted line phantom in FIG. 3. Similarly, the inner surface 34 of the head, rearwardly from the face 14, and extending between the sole 22 and the arch 18, (see FIG. 2) is also shown in phantom. A pair of tapped apertures, aperture 30 and aperture 32, are both shown in phantom in FIG. 3 and they are disposed at the thickest portion of the head adjacent the outer portions of the face 14 and adjacent the sides 23 and 25.

The outline of the golf club apparatus 10 from the top view, as shown in FIG. 3, is generally circular from the outer portions of the face 14. That is, the outer periphery of the head, from one end of the face 14 to the opposite edge or end of the face 14 from side 23 to side 25 is a constant curve of varying radius, which, while not a perfect circle, is generally circular in configuration.

From the upper view of FIG. 3 may be seen the circular configuration of the head, and from the side view of the golf club apparatus of FIG. 3 may be seen the curvature of the head extending rearwardly from the face 14 which comprises both the upper or top surface of wing 16 and the underneath or arch 18. Thus the golf club head may be considered as an aerodynamic body with an airfoil type configuration which allows a smooth flight of the head through the air as the user of the golf club swings or moves the head in a downward arc from the top or upper position of the head as he drives with the golf club head. The aerodynamic configuration allows the golf club head to move smoothly through the air with a minimum of wind resistance and also with a minimum adverse reaction due to the movement of the head rapidly through the air. The design shown in FIGS. 1, 2 and 3 maximizes the efficiency of the head as it moves through the air, minimizes the drag, and maximizes the stability of the head and the velocity of the head, due to the airfoil configuration thereof.

FIG. 4 is a view in partial section taken generally along line 4—4 of FIG. 3. It is a view showing an enlarged view and partial section of a portion of the microbalancing system used in the golf club head apparatus. In the front portion of the head, between the face 14 and the arch 18 and beneath the wing 16, there are disposed a pair of tapped apertures 30 and 32, as shown in phantom in FIG. 3. The line 4—4 of FIG. 3 extends through one of the tapped apertures 32, and FIG. 4 is thus a view in partial section of the tapped aperture 32 and the head 10. It includes the portion of the head as described above, between the face 14, the arch 18, the sole 22, and the wing 16.

The tapped aperture 32 extends upwardly into the head from the sole 22. The tapped aperture is disposed substantially perpendicular to the hole 22. Within the tapped aperture 32 is a plug 36. The plug is externally threaded to match the internal threads of the aperture 32. The plug includes a slot 37 which may be used to adjust the plug as desired in the tapped aperture 32.

As illustrated in FIG. 4, the plug 36 has an overall length about one-third that of the length of the aperture 32. Accordingly, the plug may be located in numerous positions within the aperture 32. The plug may be made of any appropriate weighted material, such as lead, steel, iron, or any appropriate alloy, or even plastic. Indeed, for various individuals, plugs of vairous weights will be necessary to suit the requirements of various users of the golf club head apparatus comprising the present invention.

The slot 37 allows the plug 36 to be located as desired by the user of the apparatus. With a pair of apertures, such as 30 and 32 as shown in FIG. 3, the individual user will be able to adjust the weight and balance of a golf club head to suit the individual style and requirements as is appropriate. Thus the weight of the head may be adjusted or distributed to compensate for hooks, slices, or any other problem which an individual may have, or merely to accommodate a particular swing or "feel" that a particular user will have or will desire.

FIG. 5 is a view in partial section similar to that of FIG. 4, showing the plug 36 in a different position and with additional apparatus. As in FIG. 4, tapped aperture 32 extends upwardly within the golf club head apparatus 10 substantially perpendicular to the sole 22, and between the sole and the top wing surface 16, and between the face 14 and the arch 18.

Within the tapped aperture 32, and above the threaded plug 36, is a lightweight insert 40. The insert 40, light in weight, and made of material, such as plastic, is used to simply occupy space within the aperture and thus to allow the plug 36 to be threadedly inserted within the aperture 32 against the insert. Thus the plug can be tightened within the aperture against the insert rather than simply using a screwdriver in slot 37 of the plug to orient the plug in a random fashion within the aperture 32. The insert may be used in the aperture to specifically locate the threaded plug. If it is desirable to locate a threaded plug in the aperture 30, (see FIG. 3) in a similar location to that of the plug in the aperture 32, another insert, of the same length as insert 40, may be used in aperture 30. Thus the two plugs would be located within the two apertures at substantially the same location. Inserts, such as insert 40, may be fabricated of any appropriate, lightweight material, such as plastic, and may be solid or hollow, as desired, or they may be weighted. Such inserts may be made in any appropriate length and density as desired.

FIG. 6 is a view in partial section of the apparatus illustrated in FIGS. 4 and 5, and shows a pair of inserts disposed in aperture 32 above plug 36.

If it is desired by a user of the golf club head apparatus 10 to locate the plug 36 closer to the sole 22 in the aperture 32, another insert 41, weighted or unweighted, may be inserted in the aperture adjacent insert 40. As shown in FIG. 6, the plug 36 will then be threadedly inserted into the aperture 32 and snugged against the insert 41. The insert 41 is disposed adjacent and against insert 40 and thus the plug 36 is disposed solidly within the aperture 32.

Depending on the individual user of golf club head apparatus embodying the present invention, it may, or it may not be desirable to distribute the weight of plugs and inserts evenly or substantially parallel in the pair of apertures 30 and 32. For example, the swing of each individual varies from virtually every other individual. Accordingly, optimum balancing of the head of a golf club may be accomplished by varying the weight distribution in the two apertures in the head to compensate or to accommodate for the style and manner of swing of each individual user. The microbalancing system employed with the design of the head thus allows precise location of weights in the apertures in the golf club head.

FIG. 7 is an isometric view of an alternate embodiment of apparatus of the present invention. In the apparatus of FIG. 7, the small sole area is maintained, but the supporting rib or center web of the apparatus illustrated in FIGS. 1, 2, and 3, is eliminated by a generally circular sole extending from the face of the club.

Golf club head 60 of FIG. 7 includes a hosel 62 extending from the club head generally upwardly to connect with an appropriate shaft. The front of the club head comprises a face 64. A wing 66 extends rearwardly from the upper portion of the face 64. The top of the wing 66 is aerodynamically configured, and convex in general shape, to provide a smooth trajectory as the club is moved through the air during the swing of the user, with minimum tendency to move or change position due to aerodynamic forces against the head throughout the course of the swing. The wing extends from the face 64 backwardly and terminates in a trailing edge 70. The club head also includes a pair of sides, of which side 65 is shown in FIG. 7 extending between the face 64, the wing 66, and the sole of the club head.

Figure 8:
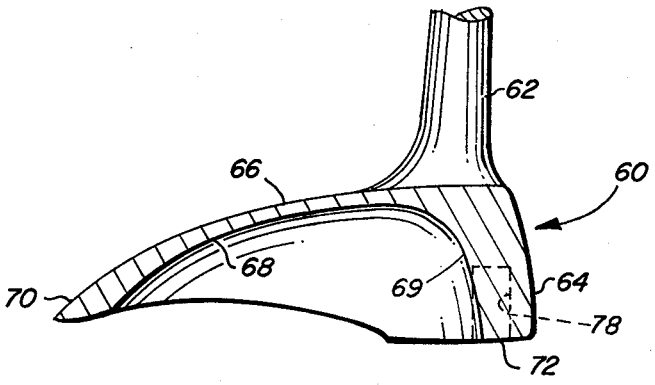
FIG. 8 is a view in partial section taken along line 8—8 of FIG. 7.

FIG. 8 is a view of the apparatus of FIG. 7 taken generally along line 8—8 of FIG. 7. The view comprises a side view in partial section of the golf club head 60 of FIG. 7. The hosel 62 is shown extending upwardly from the head 60 and the face 64 is shown at the front of the club. The wing 66 extends backwardly or rearwardly and downwardly from the upper portion of the face 64. The top wing surface terminates in a trailing edge 70 at the rear of the head. The top surface of the wing 66 is generally convex in shape and comprises an aerodynamic surface which is generally a continuous curve from the juncture of the wing surface 66 and the face 64 to the trailing edge 70 at the rear of the head. The golf club head 60 is relatively hollow, and it includes an inner concave surface or arch 68 extending from the sole 72 upwardly and rearwardly to the trailing edge 70. The thickness of the golf club head 60 varies from a maximum between the arch 68 and the face 64 to a minimum beneath the top wing surface 66 and the thickness increases slightly adjacent the trailing edge 70. The arch 68 comprises a concave or hollow portion of the golf club head which minimizes the weight of the head and allows the weight to be concentrated adjacent to face 64. With the weight concentrated at the face, or adjacent the face, and the design of the head in an aerodynamic configuration, maximum efficiency of the head is achieved.

Figure 9:
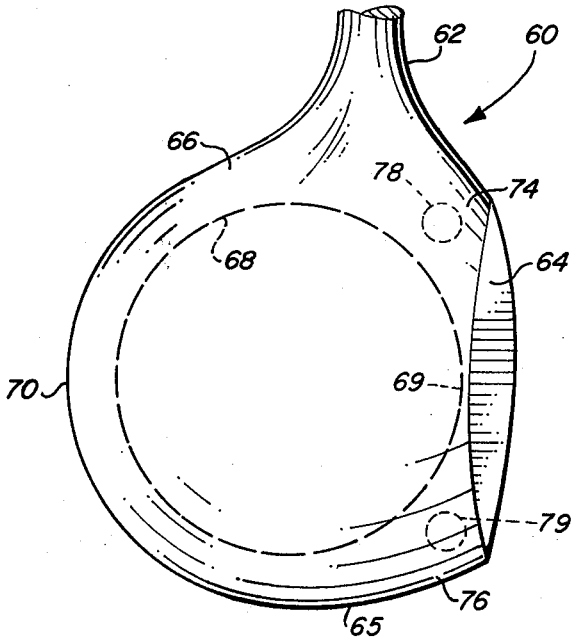
FIG. 9 is a plan view of the apparatus of FIGS. 7 and 8.

The sole 72 extends outwardly and rearwardly from the face 64 and is thus larger in total area than the sole of the golf club head as illustrated in FIGS. 1–6. However, the area of the sole included in the embodiments of FIGS. 7, 8, and 9 is still substantially smaller than the area of the sole of golf clubs of the prior art. The front portion of the concave arch 68 closest to the face 64 comprises an inner recess 69, which is centrally located with respect to the face. Outwardly from the inner recess and adjacent the face the head includes a pair of tapped apertures, of which aperture 78 is shown in FIG. 8, to receive weights for the microbalance apparatus described above. The recess 69 and the apertures are shown more clearly in FIG. 1.

FIG. 9 is a top view of the golf club head apparatus 60 of FIGS. 7 and 8. The hosel 62 is shown extending outwardly from the head 60, and the face 64 is shown extending downwardly from the wing 66. The trailing edge 70 of the wing, which obviously is the trailing edge of the golf club head, is remote from the face 64. The overall configuration of the golf club head as shown in FIG. 9 is substantially circular except for the face 64. That is, the generally planer configuration of the face 64 comprises a chord with respect to the overall generally circular configuration of the head as it, the face, intersects the head from the top of the wing downwardly at an angle. The arch 68, shown in phantom in FIG. 9, is shown as having a substantially circular configuration.

The configuration of the arch adjacent the sole 72 (see FIG. 8) and the face 64 is such as to leave maximum thickness at two locations adjacent the face 64. The first location, an inner side portion 74, is located between the face 64 and the hosel 62, and the second, or outer side portion 76, is located at the opposite end of face 64 and remote from the hosel, and adjacent and inwardly from side 65 62. While not shown specifically in FIGS. 7, 8, or 9, the microbalance system illustrated specifically in FIGS. 1–6 may be included in the embodiment of FIGS. 7, 8, and 9. A pair of tapped apertures 78 and 79 are shown in phantom located at the inner side portion 74 and at the outer side portion 76. The tapped apertures extend upwardly from the sole 72, substantially the same as shown in detail in FIGS. 4, 5, and 6.

In the embodiment of FIGS. 7, 8, and 9, the aerodynamic efficiency of the head is substantially similar to the embodiment of FIGS. 1–6. However, the center supporting web or rib is not needed in the embodiment of FIGS. 7–9 because the sole extends over a larger area, outwardly from the face 64, and including the inner side portion 74 and outer side portion 76. The extra lateral support provided by the portions 74 and 76 extend the sole 72 outwardly and rearwardly sufficiently to provide stability for the head when resting on the ground.

Figure 10:
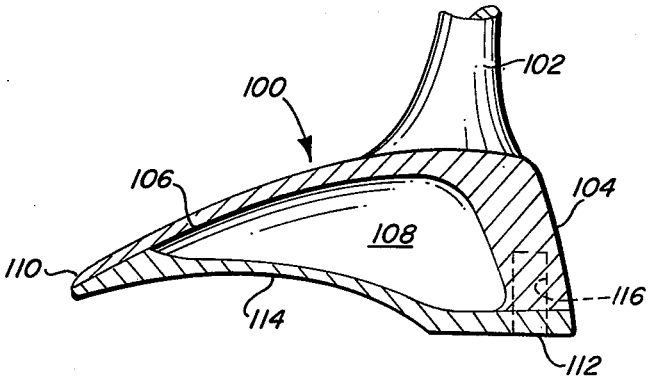
FIG. 10 is a view in partial section of another embodiment of the present invention.

FIG. 10 is a side view, in partial section, of golf club head apparatus 100 which comprises an alternate embodiment of the apparatus included in the present invention. The golf club head 100 retains the characteristic aerodynamic configuration of the prior embodiments, but is hollow, with a slight concavity on the underneath side, rather than the open arch which characterizes the prior embodiments.

The head 100, similar to the prior embodiments, includes a hosel 102 extending upwardly from the body of the head. The head also includes a face 104 at the front of the club, and a wing surface 106 which extends in a convex curve from the upper portion of the face 104. It terminates in a trailing edge 110.

At the bottom of the golf club head 100, and adjacent the face 104 of the club, is a sole 112. The sole extends rearwardly from the face 104 for a distance which is substantially uniform along the face of the club. The distance is relatively short, with respect to the length or size of the soles of prior art golf clubs, but is a sufficient length to give the club stability when the club is disposed on the ground, ready for play. The sole 112 comprises a planar area extending substantially directly rearwardly from the face of the club. At the termination of the planar area of the sole, there is a concave curved or rear portion 114 which extends upwardly from the sole 112 and then downwardly again to terminate at the trailing edge 110 of the wing 106. The curved portion 114 is concave in configuration between the sole 112 and the trailing edge 110 of the wing. Between the wing 106 and the sole 112 and the curved portion 114 is a hollow portion 108. As the previous sentence indicates, the hollow portion 108 is bounded by, or is defined by, the inner or rear portions of the face 104, the wing 106, the sole 112, the curved portion 114, and the trailing edge 110. A pair of tapped apertures are disposed outwardly in the head from the hollow 108, and aperture 116 is shown in phantom.

Figure 11:
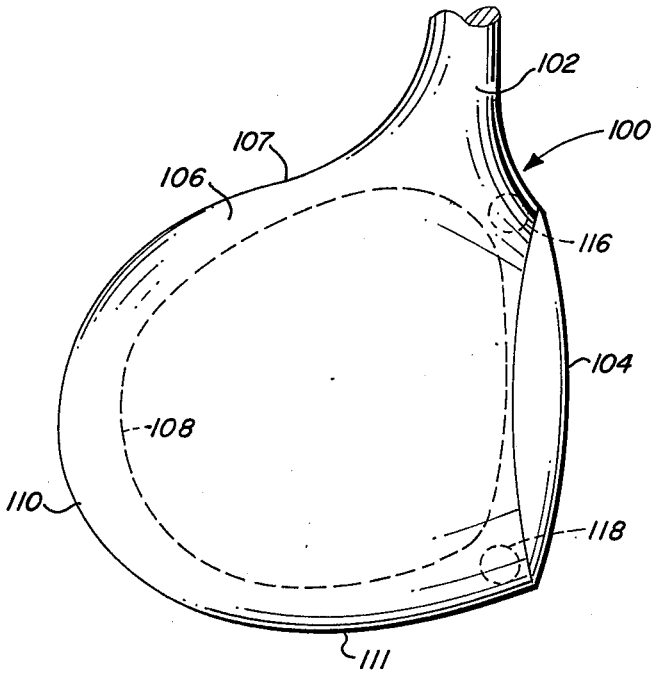
FIG. 11 is a top view of the apparatus of FIG. 10.

FIG. 11 is a plan view of the golf club head 100 of FIG. 10. In FIG. 11 may be seen the outline or view of the apparatus from the top, including the overall shape of the wing 106 as it extends from the face 104 to the trailing edge 110. The hosel 102 extends outwardly (and upwardly) from the wing 106 adjacent an edge of the face 104. The golf club head 100 does not have as generally circular a configuration as does the embodiments of FIGS. 1–9. Rather, the wing 106 includes an inner rear edge 107 which extends from the hosel 102 to the trailing edge 110. The edge 107 is relatively staight as it extends at an obtuse angle with respect to the hosel 102. The trailing edge 110 from its juncture with the rear inner edge 107 is generally curved in a circular configuration and the same general curvature continues at the outer edge 111 from the trailing edge 110 to the face 104. Thus the continuous edges, beginning at the hosel 102, including the rear inner edge 107, the trailing edge 110, and the outer edge 111, are generally e11iptical in configuration rather than circular as in the previous embodiments.

The outline of the hollow portion 108 is shown in phantom in FIG. 11. The phantom outline is the outline of the hollow portion at the inner periphery of the sole 112 and above the curve portion 114, which two portions comprise the lower or bottom part of the head 100. Tapped aperture 116 and 118, for microbalancing the head, are shown in phantom.

Figure 12:
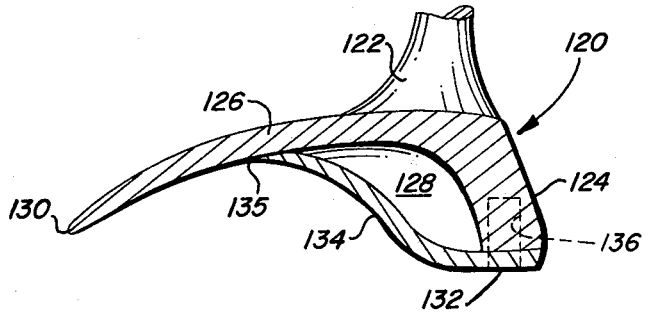
FIG. 12 is a view in partial section of another embodiment of the present invention.

FIG. 12 is a view in partial section of an alternate embodiment of the apparatus of FIG. 11, showing a golf club head 120 which has an upper configuration substantially the same as the embodiment of FIGS. 10 and 11. The golf club head 120 includes a hosel 122 extending outwardly and upwardly therefrom. The front part of the head includes a face 124 which has a slight backward slope as the face extends upwardly. From the upper portion of the face 124 there extends slightly upwardly and rearwardly a wing surface 126 which has a generally convex configuration. The wing 126 terminates in an outer edge 130. At the lower portion of the head, adjacent face 124, is a sole 132. The sole is substantially the same in area as the sole of the embodiments of FIGS. 10 and 11.

Extending upwardly from the rear edge of the sole 132, remote or away from the face 124, is a curved concave surface portion 134. The curved portion rises upwardly in a sharper curve concave surface than does the corresponding curved portion 114 of the embodiments of FIGS. 10 and 11. The curved portion 134 extends upwardly and terminates at the underneath side of the wing 126 intermediate the face 124 and the trailing edge 130, as at 135. That is, the curved portion extends to, and is secured to, the wing 126 at the location 135 on the underneath side of the wing 126 forward of the trailing edge 130, rather than at the trailing edge 130 as shown in FIG. 10. The underneath portion of the golf club head 120, rearwardly from the sole 132, thus comprises a concave portion which is substantially greater in curvature than the corresponding convex surface configuration of the wing 126. There is a hollow portion 138 within the golf club head defined between the underneath portion of the wing 126, the sole 132, and the curved portion 134. The hollow portion 128 is substantially less in volume than the corresponding hollow portion 108 shown in FIG. 10. Shown in phantom is tapped aperture 136, one of a pair which extends upwardly and inwardly into the head from the sole 132 for the microbalancing system.

The thickness of the head adjacent the face 124 is generally regular in thickness in both the embodiments of FIGS. 10, 11, and 12. Thus the primary difference between the embodiments as shown in FIGS. 10 and 12 is the concave configuration on the underneath portion of the head. Both wings are aerodynamically configured, as in the previous embodiments, and the heads are of sufficient thickness to allow the use of the microbalance system shown in detail in FIGS. 4, 5, and 6. The same advantages of the aerodynamic configuration of the wing, with its convex upper surface, and the concave lower configuration adjacent the sole, and the small sole area, are still present as in all embodiments. Moreover, each of the heads includes a relatively small sole area which minimizes turf drag and club bounce.

Figure 13:
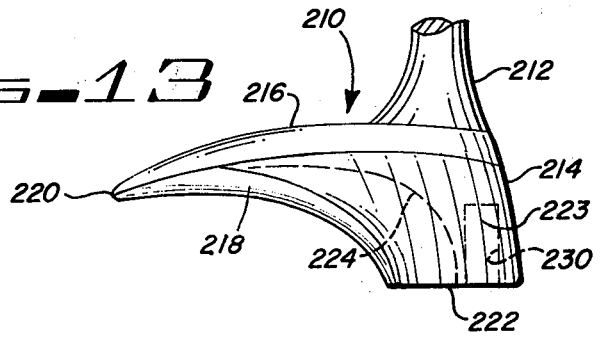
FIG. 13 is a side view of an alternate embodiment of apparatus included in the present invention.

In FIG. 13, golf club head apparatus 210 includes a hosel 212 and a face 214 which slopes upwardly and rearwardly from a sole 222 to a wing 216 which defines a convex surface. From the top or upper portion of the face 214, and inwardly from an outer side 223, the wing surface 216 extends rearwardly and terminates in a trailing edge 220. The surface of the wing 216 is of a curved, aerodynamic configuration, substantially similar to the configuration of the wings in the prior embodiments herein. Beneath the wing 216 is an arch 218, which defines a concave surface and which extends from the rear portion of the sole 222 in a continuous curve upwardly and rearwardly to the trailing edge 220. The area of the sole 222 is small with respect to the overall size or area of the head apparatus 210, but it is of sufficient area to stabilize the club when a club head is resting on the ground in readiness for use.

An inner recess 224 extends inwardly from the arch 218 between the sole 222 and the wing 216. The inner recess 224 comprises a concave hollow or relieved portion which substantially reduces the overall weight of the club head apparatus and yet allows for the aerodynamic configuration of the head, including the wing and the arch which provides the inherent advantages as discussed above.

Also shown in FIG. 13, in phantom, is an aperture 230 extending upwardly from the sole 222. The aperture is used with the microbalancing apparatus as discussed above in conjunction with other embodiments and figures. The aperture 230 is disposed in the head inwardly from the outer side 223 (See FIG. 14).

Figure 14:
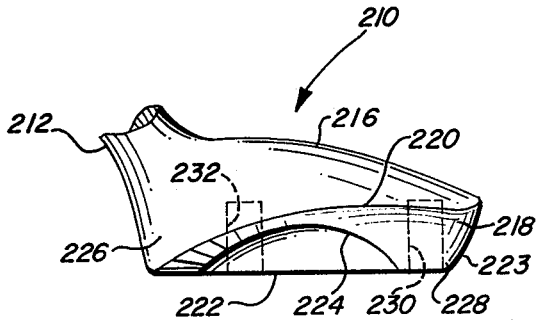
FIG. 14 is a rear view of the apparatus of FIG. 13.

FIG. 14 is a rear view of the apparatus of FIG. 13, taken generally at a right angle to FIG. 13, or in other words FIG. 14 is a view of the apparatus of FIG. 13 rotated ninety degrees from that shown in FIG. 13. The golf club head apparatus 210 is shown with the hosel 212 extending upwardly and away from the head from the wing 216 and from inner side portion 226. The trailing edge 220 of the head apparatus is shown extending at the rear or trailing portion of the wing above the arch 218 and from the outer side 223 to substantially adjacent the sole 222 at the inner side portion 226. The trailing edge accordingly is curved downwardly from the outer portion of the golf club head. The inner recess 224 extends upwardly and rearwardly from the sole 222 to blend into the arch 218. A pair of apertures 230 and 232, tapped to receive microbalance apparatus as described above, extend upwardly from the sole 222 into the golf club head from an outer side portion 228 and from the inner side portion 226, respectively.

The continuous nature of the curvature of the wing 216 and of the trailing edge 220 are clearly shown in FIGS. 13 and 14.

While the principles of the invention have been made clear in illustrative embodiments, there will be immediately obvious to those skilled in the art many modifications of structure, arrangment, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Golf club head apparatus, comprising, in combination:

a face having an upper portion and a lower portion;

sole means extending rearwardly from the lower portion of the face;

an inner side portion and an outer side portion extending rearwardly from and adjacent to the face and upwardly from the sole means;

a substantially continuous convex surface extending rearwardly from the upper portion of the face and inwardly from the inner and outer side portions and forming the upper surface of the club head;

a concave surface, including an inner recess between the inner and outer side portions, extending substantially continuously upwardly and rearwardly from the sole means to the convex surface, the juncture of the convex surface and the concave surface defining an edge, said edge extending in a curve between the outer side portion and the inner side portion; and weight means disposed in the head adjacent the inner and outer side portions for adjusting the balance of the club head.

2. The apparatus of claim 1 in which the sole means includes a pair of apertures for receiving the weight means.

3. The apparatus of claim 2 in which the apertures are tapped and the weight means includes threaded plugs to provide threaded engagement with the tapped apertures.

4. The apparatus of claim 3 in which the weight means further includes insert means for varying the location of the threaded plugs in the apertures.

5. The apparatus of claim 4 in which the inner recess extends outwardly, rearwardly, beneath and substantially coextensive with the convex surface.

* * * * *